United States Patent [19]

Magee

[11] Patent Number: 4,597,606

[45] Date of Patent: Jul. 1, 1986

[54] ARM CAP FOR AIRPLANE SEAT OR THE LIKE

[75] Inventor: Ted N. Magee, Hillsborough, Calif.

[73] Assignee: Magee Plastics Company, San Mateo, Calif.

[21] Appl. No.: 650,954

[22] Filed: Sep. 17, 1984

[51] Int. Cl.[4] ..... A47C 1/12

[52] U.S. Cl. ..... 297/422; 248/118; 297/411

[58] Field of Search ..... 297/422, 411, 195; 248/118

[56] References Cited

U.S. PATENT DOCUMENTS

| | | | |
|---|---|---|---|
| 334,756 | 1/1886 | Denver | 297/422 |
| 1,756,694 | 4/1930 | Loehr | 248/118 |
| 2,980,162 | 4/1961 | Bourgois | 297/195 |
| 3,815,953 | 6/1974 | Worley | 297/195 |
| 4,026,600 | 4/1977 | Kutaguchi | 297/195 X |
| 4,331,360 | 5/1982 | Roudybush | 297/422 |

*Primary Examiner*—James T. McCall

*Attorney, Agent, or Firm*—Townsend and Townsend

[57] ABSTRACT

An arm cap in the form of a resilient support for an armrest of a seat, the arm cap including an upper, resilient member and a lower rigid member secured to the upper member. The upper member includes a top wall and a pair of opposed side walls, each side wall having a number of inwardly projecting tabs which are connected by rivets or other fastener devices to the lower member. A layer of foam material is between the upper and lower members.

9 Claims, 3 Drawing Figures

ARM CAP FOR AIRPLANE SEAT OR THE LIKE

This invention relates to improvements in resilient accessories for use on seats or near seats, especially passenger seats in airplanes, and, more particularly, to an improved arm cap or resilient support for placement on or near the armrest of a chair or seat.

BACKGROUND OF THE INVENTION

In U.S. Pat. No. 4,331,360, a resilient accessory is disclosed for use on one of several different locations of an airplane passenger seat or other chair. The accessory disclosed in the patent includes a first resilient member and a second relatively rigid member secured to the first member by posts integral with the first member and passing through holes in the second member, the posts having lower heads which are flattened by the application of heat to form heads which permanently connect the upper and lower members together with the lower members being in engagement with downwardly projecting partitions integral with the inner surface of the upper or first member.

While the foregoing construction is suitable for a number of different applications, it has been found that other applications of an arm cap might be improved by using another type of interconnection means for coupling the upper and lower members together. The present invention satisfies this additional need for improvements in an arm cap of the type described.

SUMMARY OF THE INVENTION

The present invention is directed to an improved resilient support which can be used as an arm cap for an armrest of a chair or seat, such as an airplane passenger seat. To this end, the support of the present invention includes an upper resilient member having a top wall and a pair of side walls integral with the top wall, each side wall having a plurality of inwardly projecting tabs which are used to engage a second, rigid member between the side walls so that rivets or other fastening devices can interconnect the second member and the tabs. In this way, the first and second members are rigidly and positively interconnected to form a durable, sturdy unit of rugged construction.

A layer of resilient foam material is preferably placed between the first and second members to add resilience to the overall arm cap itself. The tabs can be formed as integral parts of the side walls of the first member, and the fastening devices can be in the form of pop rivets which can be easily put into place with a conventional rivet.

The primary object of the present invention is to provide an improved resilient support adapted for use on or near the armrest of a chair or seat wherein the support includes an upper resilient member, a lower rigid member, and improved structure for rigidly securing the upper and lower members together to thereby provide a positive lock between the members as well as to provide a construction which is simple and rugged and is inexpensive to produce.

Other objects of this invention will become apparent as the following specification progresses, reference being had to the accompanying drawings for an illustration of the invention.

IN THE DRAWING

Figure 1:
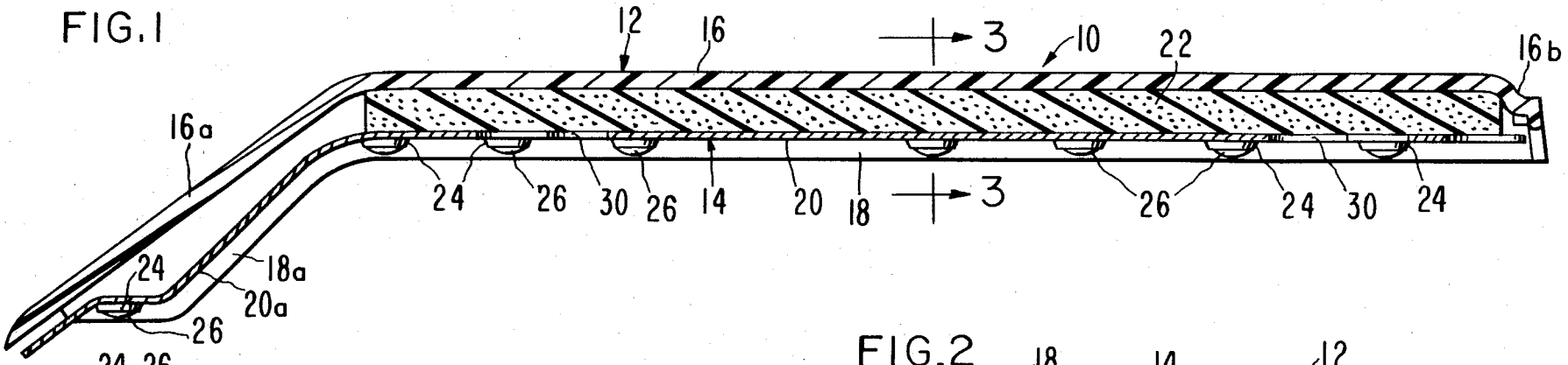
FIG. 1 is a vertical section through the improved arm cap present invention.

The arm cap of the present invention is broadly denoted by the numeral 10 and is suitable for use with a number of different applications. One application is the use of arm cap 10 as an armrest of a chair, such as a passenger seat of an airplane.

Arm cap 10 includes an upper member 12 of resilient material and a lower member 14 which is generally rigid and in the form of a plate. Member 14 is located in or near a bottom opening in member 12. Both members 12 and 14 are of lightweight construction and are selected from materials which minimize the weight of arm cap 10 yet provide a construction which is strong and durable. For this purpose, member 12 is preferably molded from a polyurethane material or other suitable plastic, and member 14 is formed from aluminum.

Figure 2:
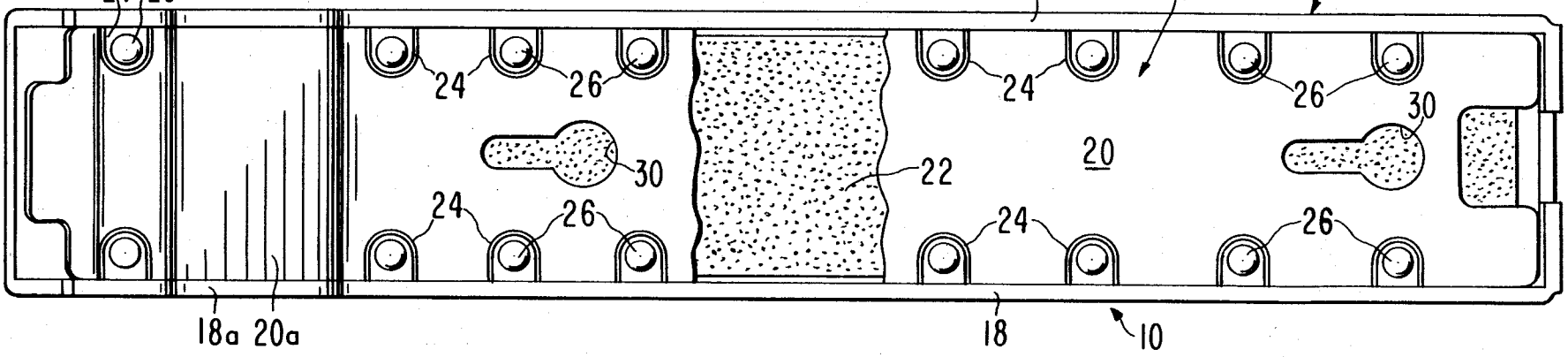
FIG. 2 is a bottom plan view of the arm cap of FIG. 1, parts being broken away to illustrate details of construction.
Figure 3:
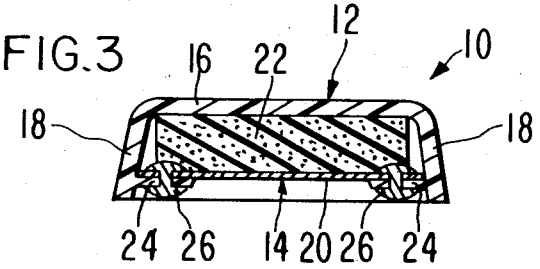
FIG. 3 is a cross-sectional view taken along line 3—3 of FIG. 1.

Member 12 has a top wall 16 and a pair of side walls 18 which diverge with respect to each other as the lower margins of the side walls 18 are approached (FIG. 3). The lower margins of the side walls 18 define the bottom opening in member 12. The upper surface of top wall 16 can be flat as shown or can be slightly convex. The outer surfaces of top wall 16 and side walls 18 are generally smooth and the junctions between the top wall and the side wall are slightly curved as shown in FIG. 3. To suit a specific chair or seat application, top member 16 has an inclined end segment **16*a* provided with corresponding side walls 18*a* (FIGS. 1 and 2). Other applications of the arm cap of the present invention will dictate the ultimate shape of top walls 16 and side walls 18, especially at the ends thereof. To this end, top wall 16 has a slight recess 16*b* at the end opposite to segment 16*a*** for insertion into adjacent hold-down structure for releasably securing the end of the cap to the chair or seat, such as the passenger seat of an airplane, with which the arm cap is used. Similar hold-down means is provided for the opposite end of the arm cap.

Member 14 has a main portion 20 which is generally parallel with and spaced below top wall 16 as shown in FIGS. 1 and 3. An end segment **20*a* forms a part of main portion 20 and extends downwardly and generally parallel with segment 16*a* of top wall 16. A layer 22 of resilient foam material is in the space between top wall 16 and main portion 20, layer 22** providing additional resilience for the arm cap to assure that shock or other forces applied to the arm cap are absorbed while preventing damage to the arm cap itself.

Member 14 is coupled to member 12 so that they form a unitary construction. To this end, side walls 18 have a number of inwardly projecting tabs 24 which are integral with respective side walls 18; thus, tabs 24 can be formed in a molding process along with top wall 16 and side walls 18. The tabs 24 are spaced slightly above the lower margins of side walls 18 and each tab 24 has a hole therein for receiving a pop rivet 26 which also extends through a corresponding hole in member 14, whereby the member 14 is rigidly secured to member 12.

Any suitable number of tabs 26 may be provided. For purposes of illustration, there are a total of 7 tabs 24 for each side wall 18 and a single tab 24 for each side wall segment 18*a*. All tabs 24 have rivets 26 or other fastener devices associated with them so that the side walls and side wall segments of member 12 are effectively and securely coupled to member 14 to provide a rigid, stable interconnection therebetween.

Each rivet 26 has a head at each end thereof and the rivet is put into place with a conventional rivet gun. Each rivet can be put into place even though layer 22 is between members 12 and 14, layer 22 being moved out of the way during the riveting step to accommodate the inner head of the rivet so that the inner head projects inwardly from member 14 in the manner shown in FIG. 3.

When members 12 and 14 are connected together in the manner shown in FIGS. 1 and 3, arm cap 10 is ready to be installed on an armrest. To this end, cap 10 is placed on the armrest so that the ends of top wall 16 are in positions to be engaged by the end moldings ordinarily carried by the armrest. Keyhole slots 30 are provided to receive studs on the armrest for releasable attachment of the arm cap to the armrest. When the moldings engage and thereby clamp or hold down the ends of the cap, the cap is ready to be used.

During use, any downward forces exerted on top wall 16 will be resisted by the resilience of the top wall itself as well as by foam layer 22. Thus, the arm cap provides a means for supporting the arm of a person sitting in the seat adjacent to the arm cap as well as provide a soft, yieldable surface to absorb shock and other forces exerted downwardly on the arm cap, such as when the hand of a person engages the arm cap when the person is sitting down or leaving the chair itself.

Other embodiments using the teachings of the present invention can include a seat cushion for a chair or other support. The seat can be of any desired shape, such as square, rectangular, circular or hexagonal. In all cases, the seat will include an upper resilient member provided with spaced tabs, and a lower member of rigid material, such as aluminum. The upper and lower members will be coupled together by pop rivets of the type described above with respect to arm cap 10. The upper and lower members will be of lightweight construction and the seat cushion or other support will be of lightweight construction having an attractive appearance and suitable for immediate mounting in an operative position.

I claim:

1. A resilient support comprising:

a first member of resilient material, the first member having a top wall and a pair of spaced side walls integral with the top wall, the space between the side walls defining an opening in the first member opposite to the top wall, there being a number of generally flat tabs secured to and extending inwardly from the inner surfaces of the side walls, at least a number of said tabs being in a common plane;

a generally rigid, generally flat second member across said opening and spanning the distance between the side walls of the first member;

means extending through the tabs and the second member for interconnecting the second member and the tabs, and at least a major portion of said second member being in a plane substantially parallel with the plane of said tabs.

2. A support as set forth in claim 1, wherein said connecting means comprises a fastening device for each tab, respectively.

3. A support as set forth in claim 2, wherein each fastening device comprises a rivet.

4. A support as set forth in claim 1, wherein the tabs are integral with respective side walls.

5. A support as set forth in claim 1, wherein is included a layer of resilient material between the first and second members.

6. A support as set forth in claim 5, wherein said layer is of a foam material.

7. A support as set forth in claim 6, wherein said foam material engages the inner surfaces of the first and second members.

8. A support as set forth in claim 1, wherein the tabs are spaced above and are proximal to the lower margins of respective side walls.

9. A support as set forth in claim 1, wherein the tabs engage the lower surface of said second member.

* * * * *